US005857518A

United States Patent [19]

Vinson, Sr.

[11] Patent Number: 5,857,518

[45] Date of Patent: Jan. 12, 1999

[54] OIL WELL PUMP LEAKAGE ACCUMULATOR

[75] Inventor: Scottie M. Vinson, Sr., Lake Charles, La.

[73] Assignee: Vinson Tool Company, Inc., Lake Charles, La.

[21] Appl. No.: 824,519

[22] Filed: Mar. 26, 1997

Related U.S. Application Data

[60] Provisional application No. 60/014,546 Apr. 2, 1996.

[51] Int. Cl.[6] ..... E21B 33/08

[52] U.S. Cl. ..... 166/81.1; 166/84.1

[58] Field of Search ..... 166/81.1, 84.1, 166/93.1, 68, 379

[56] References Cited

U.S. PATENT DOCUMENTS

| | | | |
|---|---|---|---|
| 1,836,130 | 12/1931 | Reighner | 166/81.1 |
| 2,032,642 | 3/1936 | Welch | 166/81.1 |
| 2,249,679 | 7/1941 | Basham . | |
| 2,480,055 | 8/1949 | Seaton . | |
| 3,180,134 | 4/1965 | Wadlington . | |
| 3,270,810 | 9/1966 | Johnston . | |
| 3,276,246 | 10/1966 | Truman et al. . | |
| 3,953,037 | 4/1976 | Winfield, Jr. . | |
| 4,530,397 | 7/1985 | Calhoun . | |
| 4,665,976 | 5/1987 | Retherford | 166/81.1 |
| 4,872,508 | 10/1989 | Gordon . | |
| 4,907,650 | 3/1990 | Heinonen | 166/84.1 X |
| 4,917,190 | 4/1990 | Coppedge . | |
| 4,951,743 | 8/1990 | Henderson . | |
| 5,211,227 | 5/1993 | Anderson | 166/84.1 |
| 5,246,067 | 9/1993 | Heinonew et al. | 166/81.1 |

*Primary Examiner*—Frank Tsay
*Attorney, Agent, or Firm*—Richard C. Litman

[57] ABSTRACT

An oil well pump leakage accumulator and bypass apparatus installable around a polish rod, and which apparatus effectively prevents contamination of the environment when the primary stuffing box in the blow out preventer unit fails. An adjustable stuffing box with a packing gland is exposed on the top of a swage assembly to collect any leaking oil and bypass the oil to a collection pipe emptying an intermediate region or chamber of the swage assembly. The chamber permits the absorption of the blow out of gas and oil resulting from the failure of the primary stuffing box in the blow out preventer unit.

9 Claims, 2 Drawing Sheets

OIL WELL PUMP LEAKAGE ACCUMULATOR

CROSS-REFERENCE TO RELATED APPLICATION

This application claims the benefit of U.S. Provisional Patent Application Ser. No. 60/014,546, filed Apr. 2, 1996.

BACKGROUND OF THE INVENTION

1. Field of the Invention

The present invention relates to an oil well pump accumulator and bypass apparatus with an adjustable stuffing box which effectively prevents any further blow,, out of oil and gas, which had resulted from a failure of the packing in the primary stuffing box in the conventional blowout preventer unit, escaping from the reciprocating polish rod and contaminating the environment. The adjustable stuffing box and packing gland are contained within an open topped swage which provides for a two-way collection of any leakage to be combined and collected. The extra volume available in the lower region of the swage softens the sudden surge of gas and oil when the primary stuffing box is blown out.

2. Description of the Revelant Art

The relevant art has long recognized the problem of a leaking stuffing box contaminating the environment and employs various methods of improving the sealing quality. However, in every description discussed below, the apparatus surrounding the primary auxiliary stuffing box is not open on top as disclosed in the present invention, but confines the stuffing box.

The pertinent art will be discussed in the order of their perceived relevance to the present invention.

U.S. Pat. No. 2,249,679 issued on Jul. 15, 1941, to Henry J. Basham describes a stuffing box gland which fits into a stuffing box with packing rings. However, the packing gland has wiper rings and an inspection plug. The packing gland has a drainage tube which returns the leaking oil back into the oil casing of the well and not to an oil recovery tank as in the present invention. The stuffing box is not adjustable in volume as in the present invention because it is fixed to the packing gland which is also fixed in position due to the drainage tube.

U.S. Pat. No. 3,180,134 issued on Apr. 27, 1965, to William H. Wadlington describes a cylindrical stuffing box closed on top with a cap containing an upper packing gland and at the bottom with a lower packing gland. The stuffing box is filled with recycling lubricant.

U.S. Pat. No. 4,917,190 issued on Apr. 17, 1990, to Donnie R. Coppedge describes a stuffing box system which surrounds the polished rod that captures oil leaking and blowing past the stuffing box packing gland. An additional closed vessel containing lubricating oil is located above the stuffing box to provide lubrication to the stuffing box gland to improve its wearing life.

U.S. Pat. No. 2,480,055 issued on Aug. 23, 1949, to Alex J. Seaton describes a stuffing box construction employing two rubber blocks with adjustable pressure as one sealing medium with three more packing gland sets above it, and topping with a conical lubrication vessel. A lubricant line feeds the intermediate packing gland set.

U.S. Pat. No. 4,872,508 issued on Oct. 10, 1989, to Richard W. Gordon describes an oil well pump leakage accumulator which is attached above and sealed, relative to the ambient, to the stuffing box. The accumulator includes ail internal chamber containing a pressure reducing plate assembly containing at least two diffuser plates. Accumulated oil is piped out from this assembly. Above the pressure reducing plate assembly, a closed lubricating housing is attached, but can be removed readily for cleaning and refilling of lubricating oil. The lubricating housing comprises two separate chambers, with each chamber containing an inner wall which supports a lubricating wick extending outwardly into the lubricating oil reservoir.

U.S. Pat. No. 4,530,397 issued on Jul. 23, 1985, to Gloria J. Calhoun describes a closed housing added above a stuffing box to collect oil leaking when the stuffing box packing wears or dries out. The housing contains a layered structure beginning from the top with a first auxiliary packing layer, a drainage ring, a second auxiliary packing layer, a first internal flange, a grease containing lubricant chamber having two discharge tubes, a second internal flange, and a large collection chamber having an outlet pipe. This closed housing is welded onto the top of the stuffing box.

U.S. Pat. No. 4,951,743 issued on Aug. 28, 1990, to Tom Henderson describes an environmental leakage protector for a polish rod which consists of a closed bellows surrounding the polish rod and connected to an oil recovery unit attached on top of a stuffing box. The oil recovery unit contains several chambers and a recovery fitting attached to a vacuum line. A fluid sensor is provided to shut off the oil pump when excessive leakage is detected.

U.S. Pat. No. 3,953,037 issued on Apr. 27, 1976, to Mason C. Winfield, Jr. describes a similar bellows arranged above a liquid receiving chamber on top of a stuffing box. The chamber provides for the separation of water from the leaking oil and the egress of the water. The apparatus is another closed system.

U.S. Pat. No. 3,270,810 issued on Sep. 6, 1966, to Leslie A. Johnston describes another bellows positioned above a hollow bonnet member on top of a stuffing box. The bonnet has a large discharge conduit for blow-by oil and water on its side. An alternative embodiment excludes the bellows member and provides for a two-piece clam shell bonnet.

U.S. Pat. No. 276,246 issued on Oct. 4, 1966, to Paul W. Truman et al. describes an auxiliary closed stuffing box with a vessel containing a leakage detector on one side and an auxiliary lubrication vessel on the opposite side. The auxiliary stuffing box is positioned on top of the primary scuffing box.

None of the above inventions and patents, taken either singly or in combination, is seen to describe the instant invention as claimed.

SUMMARY OF THE INVENTION

The present invention provides an apparatus which when added to the conventional reciprocating polish rod operating to pump oil from an oil well prevents the loss of blow out oil from the oil well and protects the environment from oil contamination. Normally, when a blow out of the packing gland occurs in the stuffing box (hereafter referred to as the primary) located below ground level in a blow out preventer cabinet, the sudden expelling mixture of gas, oil and water escapes through the passageway around the 30 to 50 foot long polish rod which pumps up the oil to contaminate the area. The present invention solves this problem by adding an auxiliary stuffing box which can adjust the sealing pressure of its packing gland against the reciprocating polish rod. Even the nominal oil leakage from the reciprocating polish rod on its up-stroke from the blow out preventer can be saved by the present invention. The present invention does not require any gages or automatic equipment to warn of a wearing down of the packing gland, but visual observance of the collection vessel on top of the swage. Then, any increase in leakage would be decreased by adjustment of the head of the stuffing box to increase pressure on the packing gland.

Accordingly, it is a principal object of the invention to provide an oil well pump leakage accumulator and bypass apparatus which effectively prevents contamination of the environment by oil leaking from a blowout of an oil well.

It is another object of the invention to provide an auxiliary adjustable stuffing box.

It is a further object of the invention to provide a unique accumulating vessel comprising a swage which contains the adjustable stuffing box and a packing gland.

Still another object of the invention is to provide a swage which is open on top to collect any oil leakage and provides adequate volume in a lower region to dissipate the effect of a sudden blow out of the oil well.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
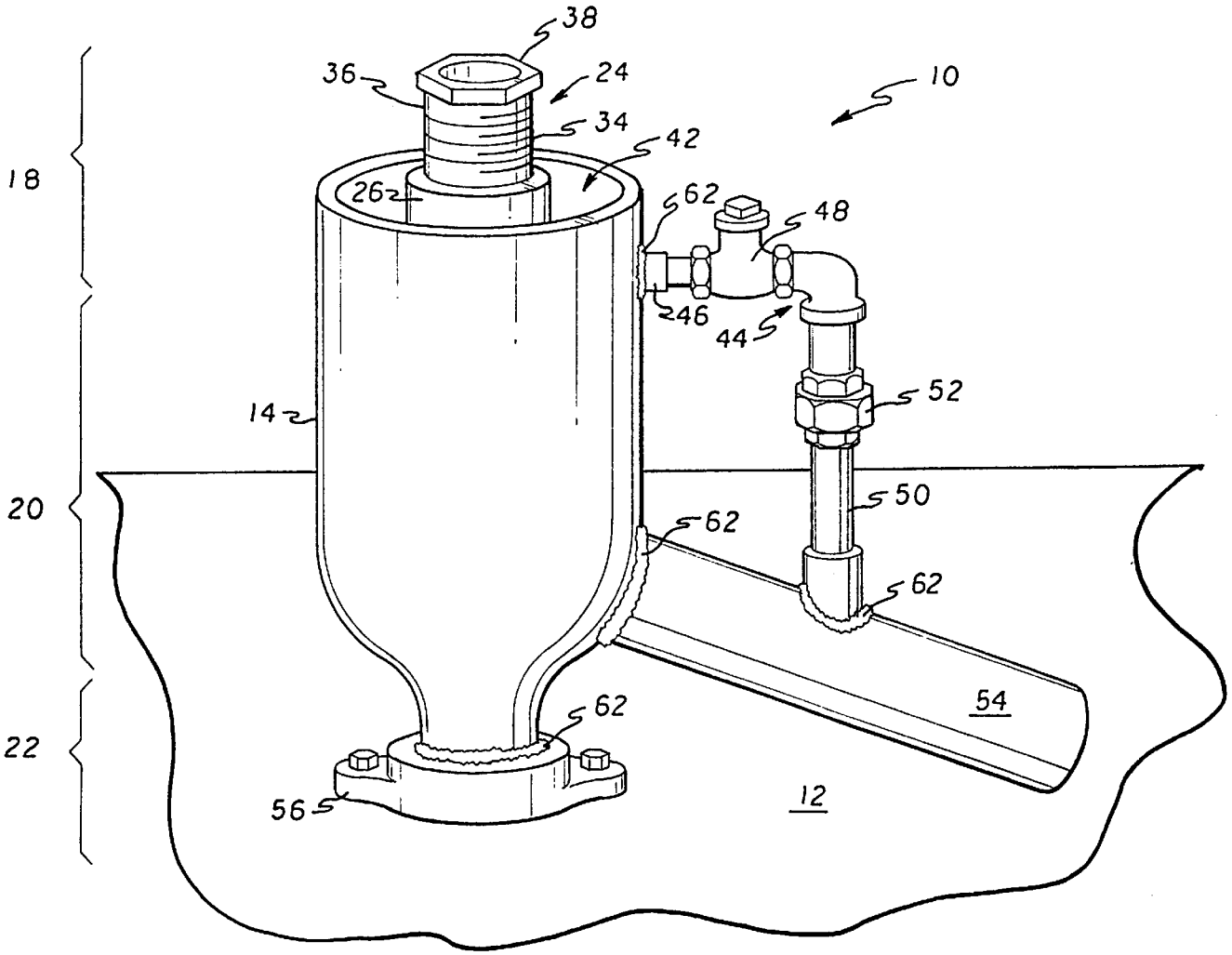
FIG. 1 is an environmental perspective view of the open oil well pump leakage accumulator and bypass apparatus.
Figure 2:
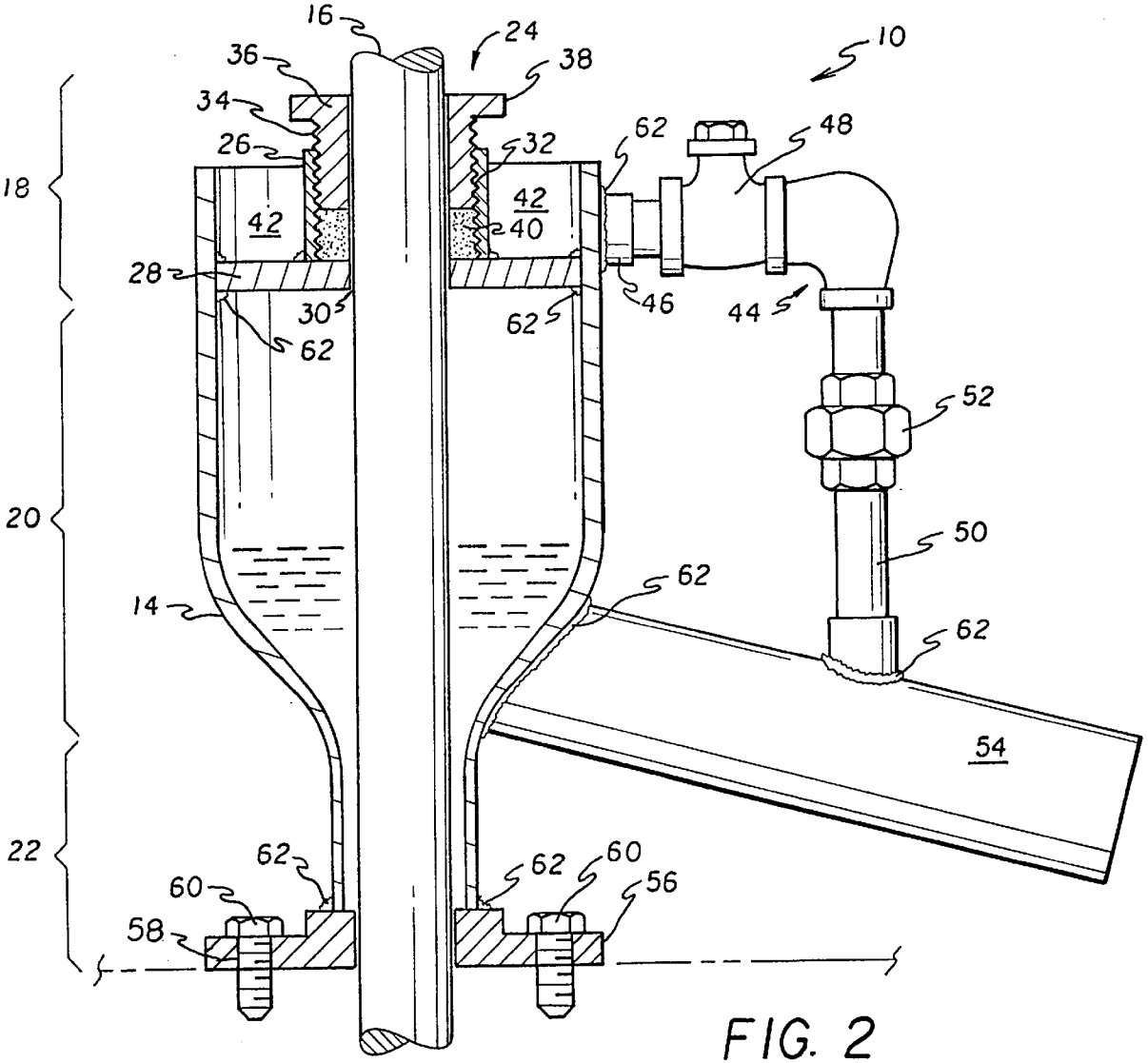
FIG. 2 is a front elevational view, partly in section, of the apparatus of FIG. 1 around a solid polish rod.

FIGS. 1 and 2 depict the inventive open oil well leakage accumulator and bypass apparatus 10 positioned on the cover of a conventional blow out preventer box 12 which has a primary stuffing box and product flow pipe inside (not shown). The apparatus 10 comprises a cylindrical swage assembly body 14 surrounding a polish rod 16 having an open enlarged upper region 18, an intermediate region 20 which reduces in diameter, and a lower narrowed region 22.

Region 18 includes an auxiliary adjustable stuffing box 24 which comprises a cylindrical steel coupling 26 welded to a horizontal steel plate 28 (also welded at weld 62 to body 14) having a central bore 30. Coupling 26 has internal threading 32 which cooperates with the external threading 34 of a packing gland 36 having a hexagonal shaped head 38. It should be noted that the cylindrical wall of the coupling 26 extends above the wall of the cylindrical swage assembly body 14. A packing material 40 is confined in the space bordered by the wall of the coupling 26, the lower surface of the packing gland 36, the horizontal plate 28, and the reciprocating polish rod 16.

As the polish rod 16 rises on each up-stroke, a minute amount of oil will seep out into the accumulator space 42 of the upper region 18. As the dripping oil collects, the oil will be conducted out of the accumulator space 42 by a return conduit 44. The return conduit 44 has a horizontal coupling 46 welded (weld region 62) to the swage body 14. A check valve 48 to prevent backflow is connected to the coupling 46 which is connected to an elbow 48. The elbow is connected to a vertical pipe 50 which includes a union 52 to facilitate the changing of the check valve 48 if necessary.

The intermediate region 20 of the swage body 14 has a uniform diameter until it meets with an oil outlet conduit 54, whereupon its diameter gradually reduces to the diameter of the lower region 22. The outlet conduit 54 extends downward at an exemplary angle of 15° from the horizontal. The conduit 54 has a larger diameter than the vertical pipe 50 of the conduit 44 which joins it. Any oil collected from both conduits 44 and 54 continues into a fiberglass storage tank by a connecting rubber or polyvinylchloride hose (both not shown). The enlarged open space available in the intermediate region 20 is critical in dissipating or mitigating the explosive force of a blow out occurrence.

The lower region 22 of the swage body 14 terminates at a horizontal base plate 56 by welding at weld region 62. The base plate is configured with at least two apertures 58 which conform with the bolts 60 and bolt apertures normally found on the blow out preventer cover. It is contemplated that three or four bolts 60 can be utilized for a stronger union.

Exemplary dimensions of the oil well pump leakage accumulator are as follows:

Swage assembly body 14: top, 6 in. O.D.; bottom, 2 in. O.D.; length, 1 ft.; Schedule 40 steel or galvanized iron.

Polish rod 16: diameter, 1.5 in.; length, 30–50 ft.

Steel plate 28: thickness, 0.5 in.; bore size diameter, slightly greater than 1.5 in.

Coupling 26: diameter, 2 in. O.D.; length 2.5 in.

Packing gland 36: length, 4 in.; hexagonal head; diameter sized to thread into coupling 26.

Packing material 40: packing gland rope.

Return conduit 44: 0.5 in. O.D. pipe with correspondingly sized couplings, elbow and union 52.

Check valve: 150 psig. capacity.

Oil outlet conduit 54: diameter, 2 in. O.D.; length, 6 in.

Base plate 56: diameter, 6 in.; thickness, 0.5 in.

Actual testing of the present invention shows that it is effective in preventing any escape to the environment of contaminating oil when a blow out of an oil pump occurs.

It is to be understood that the present invention is not limited to the sole embodiment described above, but encompasses any and all embodiments within the scope of the following claims.

I claim:

1. An open oil well pumped leakage accumulator and bypass apparatus which surrounds a polish rod comprising:

a cylindrical swage assembly body having an open enlarged upper region, an intermediate region reducing gradually in diameter, and a lower narrowed region;

said upper region containing an adjustable stuffing box which comprises:

a horizontal plate having a central bore;

a cylindrical coupling, said horizontal plate supporting said cylindrical coupling, there further being a central bore with internal threading in said cylindrical coupling;

a packing gland having a central bore with external threading, said packing gland cooperating with said cylindrical coupling to form said adjustable stuffing box;

a packing material confined in the space defined by said horizontal plate, said coupling, said packing gland, and the polish rod;

a return conduit connected to said upper region of the swage;

said intermediate region of the swage further containing an oil outlet conduit for oil being pumped from an oil well, and which outlet conduit extends downwardly;

a horizontal base plate, said lower region of the swage connected to said horizontal base plate which is fastenable to an oil well blow out preventer cover;

an elbow, said return conduit configured with said elbow joining the upper region of the swage to the oil outlet conduit; and said polish rod being confined in the bores of the adjustable stuffing box and swage, whereby the adjustable stuffing box in the open oil well pump leakage accumulator and bypass apparatus prevents loss of leakage oil to the surrounding environment during a blow out.

2. The apparatus according to claim 1, including a check valve in the return conduit, whereby backflow of oil caused by excessive oil pressure is eliminated.

3. The apparatus according to claim 2, wherein a union is located in the return conduit downstream from the check valve for facilitating the replacement of the check valve.

4. The apparatus according to claim 1, wherein the base plate is apertured to fit the fasteners present in a blow out preventer cover of an in-ground stuffing box.

5. The apparatus according to claim 1, wherein the outlet conduit extends downward at an angle of 15° from the intermediate region of the swage assembly body.

6. The apparatus according to claim 5, wherein the outlet conduit is further connected to a hose of material selected from the group consisting of rubber and polyvinylchloride.

7. The apparatus according to claim 1, further comprising a fiberglass storage tank, said hose being connected to said fiberglass storage tank.

8. The apparatus according to claim 1, wherein the packing material is a packing gland rope.

9. The apparatus according to claim 1, wherein the return duct comprises a horizontal portion containing a check valve and a vertical portion connected by the elbow, and a union in said vertical portion, whereby replacement of the check valve is facilitated.

* * * * *